US008146493B2

(12) United States Patent
Heuschkel et al.

(10) Patent No.: US 8,146,493 B2
(45) Date of Patent: Apr. 3, 2012

(54) INK FOUNTAIN OF A PRINTING PRESS, INK FOUNTAIN ROLL AND PRINTING PRESS

(75) Inventors: Jörg Heuschkel, Viernheim (DE); Martin Mayer, Ladenburg (DE); Nikolaus Pfeiffer, Heidelberg (DE); Bernhard Roskosch, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1053 days.

(21) Appl. No.: 11/870,495

(22) Filed: Oct. 11, 2007

(65) Prior Publication Data

US 2008/0250957 A1 Oct. 16, 2008

(30) Foreign Application Priority Data

Oct. 11, 2006 (DE) ..... 10 2006 048 487

(51) Int. Cl.
*B41F 31/00* (2006.01)
*B41F 31/02* (2006.01)

(52) U.S. Cl. ..... 101/352.13; 101/364; 101/350.1; 101/365

(58) Field of Classification Search ..... 101/352.13, 101/352.11, 350.6, 350.1, 349.1, 364; 492/30, 492/31, 33, 335, 36, 28
See application file for complete search history.

(56) References Cited

U.S. PATENT DOCUMENTS

| | | | | |
|---|---|---|---|---|
| 2,393,529 | A * | 1/1946 | Harrigan | 118/262 |
| 2,514,653 | A * | 7/1950 | Lerch | 101/210 |
| 3,690,254 | A * | 9/1972 | Krochert et al. | 101/352.13 |
| 4,513,662 | A | 4/1985 | Schneider | |
| 5,033,377 | A * | 7/1991 | Shimizu | 101/150 |
| 5,671,678 | A * | 9/1997 | Bolte et al. | 101/491 |
| 5,896,814 | A | 4/1999 | Junghans et al. | |
| 6,065,402 | A | 5/2000 | Feller et al. | |
| 6,378,428 | B1 | 4/2002 | Schönberger | |
| 6,439,116 | B1 | 8/2002 | Schäfer et al. | |
| 6,655,280 | B2 * | 12/2003 | Cartellieri et al. | 101/365 |
| 7,096,787 | B2 * | 8/2006 | Hino et al. | 101/351.3 |
| 2007/0261577 | A1 * | 11/2007 | Burrow | 101/348 |

FOREIGN PATENT DOCUMENTS

| | | |
|---|---|---|
| DE | 120833 | 7/1976 |
| DE | 3225176 A1 | 3/1983 |
| DE | 3241124 A1 | 5/1984 |
| DE | 3543146 A1 | 9/1987 |
| DE | 4115026 A1 | 11/1992 |
| DE | 19614191 A1 | 10/1997 |
| DE | 19717524 A1 | 11/1998 |
| DE | 19757897 C1 | 7/1999 |
| DE | 19914179 A1 | 11/1999 |
| DE | 20320598 U1 | 12/2004 |

OTHER PUBLICATIONS

European Search Report dated Jun. 4, 2010.

* cited by examiner

*Primary Examiner* — Judy Nguyen
*Assistant Examiner* — Leo T Hinze
(74) *Attorney, Agent, or Firm* — Laurence A. Greenberg; Werner H. Stemer; Ralph E. Locher

(57) ABSTRACT

An ink fountain of a printing press includes a component having a bearing face for bearing printing ink and cells made in the bearing face. An ink fountain roll for an ink fountain of a printing press and a printing press having an ink fountain, are also provided.

5 Claims, 1 Drawing Sheet

INK FOUNTAIN OF A PRINTING PRESS, INK FOUNTAIN ROLL AND PRINTING PRESS

CROSS-RELATED REFERENCE TO RELATED APPLICATION

This application claims the priority, under 35 U.S.C. §119, of German Patent Application DE 10 2006 048 487.8, filed Oct. 11, 2006; the prior application is herewith incorporated by reference in its entirety.

BACKGROUND OF THE INVENTION

Field of the Invention

The present invention relates to an ink fountain of a printing press, an ink fountain roll for such an ink fountain and a printing press having the ink fountain.

There are two types of ink fountains. In one type, one or more metering elements, for example an ink blade or a plurality of ink slides, form a metering gap together with the ink fountain roll. In the other type, a film which is situated between the metering elements and the ink fountain roll forms the metering gap together with the ink fountain roll. Irrespective of the ink fountain type, the components which form the metering gap and come into contact with the printing ink are subjected to excess wear when processing printing inks with an extremely abrasive action. In experience, printing inks with an extremely abrasive action are UV inks, white pigment inks and matt inks. For example in UV inks, the cause of the abrasive effect is their inclination to polymerize as a consequence of the hydrodynamic pressure which acts in the metering gap and their inclination to solidify into particle form in the process. The particles can grow in such a way that they accumulate in the inlet of the metering gap to form an abrasive layer.

German Published, Non-Prosecuted Patent Application DE 199 14 179 A1, corresponding to U.S. Pat. No. 6,378,428, describes an ink fountain film having wire-shaped elements which increase wear resistance. In one exemplary embodiment of that film, the wire-shaped elements are fastened on a carrier layer and are covered with a covering layer, in such a way that linear grooves extend between the wire-shaped elements.

BRIEF SUMMARY OF THE INVENTION

It is accordingly an object of the invention to provide an ink fountain of a printing press, an ink fountain roll and a printing press, which overcome the hereinafore-mentioned disadvantages of the heretofore-known devices of this general type and in which the ink fountain is sufficiently wear-resistant even when processing extremely abrasive printing inks.

With the foregoing and other objects in view there is provided, in accordance with the invention, an ink fountain of a printing press. The ink fountain comprises a component having a bearing face for bearing printing ink and cells made in the bearing face.

It has been proven in tests that particles, such as the above-mentioned UV ink particles, are rinsed from the metering gap by the cells. The component which delimits the metering gap, for example an ink fountain film or a metering element, is no longer subjected to the grinding effect of particles which accumulate in the metering gap, as a result of which service life is increased.

In contrast to a linear groove, the opening of the respective cell has an edge which is enclosed in itself all the way around.

In accordance with another feature of the invention, the bearing face forms webs which lie between the cells and take up a greater part of the surface area than the cells. Accordingly, the sum of the surface areas of the webs per unit of surface area is greater than the sum of the surface area of the cells.

In accordance with a further feature of the invention, the cells have an opening with an opening width which is less than 1 millimeter. The opening width can be the side length of a square if the respective cell has the shape of a hollow pyramid and the opening is accordingly square.

In accordance with an added feature of the invention, the opening is round and the opening width is a diameter. This geometry exists if the respective cell has the shape of a spherical cap or a hollow cone.

In accordance with an additional feature of the invention, the cells have a depth which is at most 50% of the opening width. Accordingly, the respective cell is at most half as deep as it is wide.

In accordance with yet another feature of the invention, the cells are disposed in a regular pattern. For example, the cells can be disposed in the manner of a chessboard pattern.

In accordance with yet a further feature of the invention, the component which has the cell structure is an ink fountain roll. The ink fountain roll is preferably of a type which is made contact with periodically by a ductor roll.

With the objects of the invention in view, there is also provided an ink fountain roll for an ink fountain of a printing press. The ink fountain roll comprises a bearing face for bearing printing ink, and cells made in the bearing face.

In accordance with another feature of the invention, the cells which are made in the ink fountain roll form a regular pattern. In a deviation from this preferred development, however, the cells can also be made in the circumferential or peripheral surface of the ink fountain roll in an irregular or random distribution.

With the objects of the invention in view, there is concomitantly provided a printing press, comprising an ink fountain according to the invention.

Other features which are considered as characteristic for the invention are set forth in the appended claims.

Although the invention is illustrated and described herein as embodied in an ink fountain of a printing press, an ink fountain roll and a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
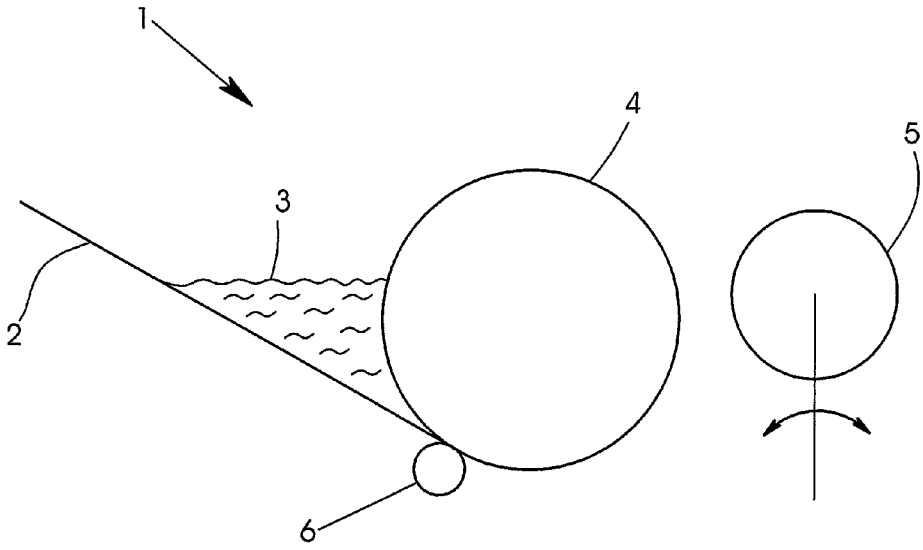
FIG. 1 is a fragmentary, diagrammatic, cross-sectional view of an ink fountain having an ink fountain roll.

Referring now to the figures of the drawings in detail and first, particularly, to FIG. 1 thereof, there is seen a portion of a printing press 1 for printing sheets in offset printing. The figure shows an inking unit which includes an ink fountain 2 having an ink fountain roll 4 and a ductor roll 5. The ink fountain 2 accommodates a wedge-shaped supply of printing ink 3 and is equipped with a metering device 6 which is divided into individually controllable inking zones over the printing width. During printing operation, the ductor roll 5 bears periodically against the ink fountain roll or component 4, in order to receive the printing ink from the latter. The ink fountain roll 4 is provided on the circumferential side with a macroscopic cell structure which is shown in FIG. 2 in an enlarged section.

Figure 2:
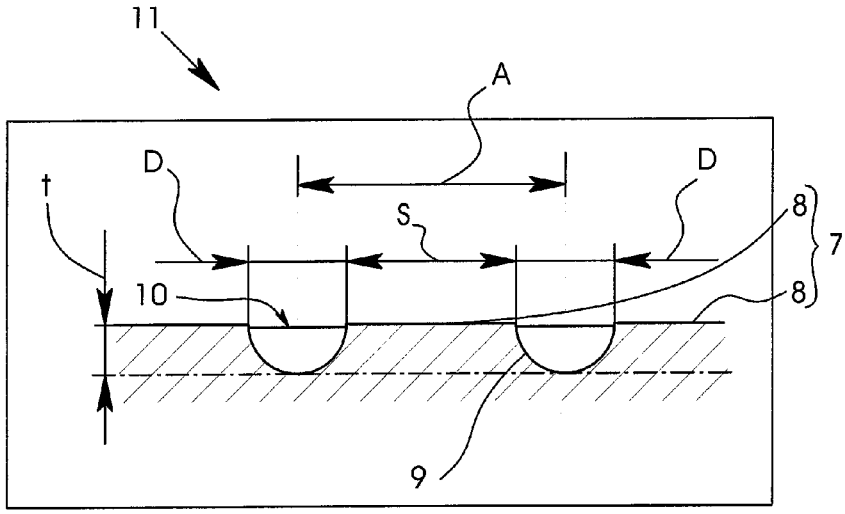
FIG. 2 is a plan view of a surface structure of the ink fountain roll of FIG. 1.

FIG. 2 shows that the circumferential surface of the ink fountain roll 4 forms a bearing face 7 which includes webs 8 that merge into one another in the manner of a mesh. Cells 9 are made in the circumferential surface in accordance with a pattern 11, for example by laser engraving. The pattern 11 has a pattern width in accordance with a center spacing A of the cells 9. The center spacing A can, for example, be from 400 μm to 900 μm. A cell spacing S which is to be measured from cell to adjacent cell and corresponds to a width of the webs 8 can, for example, be from 200 μm to 600 μm. Each of the cells 9 has an opening 10 with an opening width or diameter D which can be from 200 μm to 300 μm. A depth t of a respective cell 9 is at least 10 μm.

For example, in the case of an approximately 76% bearing or surface area proportion of the webs 8 or bearing face 7, the center spacing A is approximately 500 μm, the cell spacing S is approximately 280 μm, the diameter D is approximately 250 μm and the depth t is approximately 15 μm.

One variant which is preferred has an approximately 88% bearing or surface area proportion of the webs 8 or bearing face 7, a center spacing A being approximately 770 μm, a cell spacing S being approximately 560 μm, a diameter D being approximately 275 μm and a depth t being approximately 15 μm.

The cells 9 which are made in the ink fountain roll 4 prevent dirt and ink particles from clogging the ink gap which is present between the ink fountain roll 4 and the metering device 6 or, in the case of an ink fountain film which is inserted between the ink fountain roll 4 and the metering device 6, between that ink fountain film and the ink fountain roll 4. The cells 9 prevent the agglomeration of the printing ink 3 in the ink gap and reduce wear of the ink fountain roll 4, which dirt or ink particles or agglomerations would otherwise bring about. As a result, the reproduction accuracy of the setting of the metering device 6 is increased and quality deviations of the printed image are reduced. The ink fountain roll 4 is particularly suitable for the case in which the printing ink 3 is a UV ink.

The invention claimed is:

1. A printing press, comprising:

an ink fountain including:

a metering device having ink zones for zonal ink metering, and an ink fountain roller having a bearing face for bearing printing ink and cells formed in said bearing face, said cells being disposed in a regular pattern with a pattern width of 400 μm to 900 μm, said bearing face having a surface area and webs lying between said cells and taking up a greater part of said surface area than said cells; and a ductor roll for periodically contacting said ink fountain roller.

2. The printing press according to claim 1, wherein said cells have an opening with an opening width of less than 1 millimeter.

3. The printing press according to claim 2, wherein said opening is round and said opening width is a diameter.

4. The printing press according to claim 2, wherein said cells have a depth being at most 50% of said opening width.

5. The printing press according to claim 1, wherein said webs have a width of 200 μm to 600 μm.

* * * * *